United States Patent [19]

Lehtinen

[11] Patent Number: 4,899,461

[45] Date of Patent: Feb. 13, 1990

[54] METHOD OF DRYING A PAPER BOARD OR PAPER WEB

[75] Inventor: Jukka Lehtinen, Helsinki, Finland

[73] Assignee: Oy Tampella AB, Tampere, Finland

[21] Appl. No.: 296,506

[22] Filed: Jan. 12, 1989

[30] Foreign Application Priority Data

Jan. 29, 1988 [FI] Finland ..... 880407

[51] Int. Cl.[4] ..... D21F 5/00; F26B 3/20

[52] U.S. Cl. ..... 34/13; 34/14; 34/41; 162/206; 162/207

[58] Field of Search ..... 162/206, 207, 358, 359, 162/290; 34/12, 13, 14, 41, 70, 73, 162; 100/93 P, 38

[56] References Cited

U.S. PATENT DOCUMENTS

| | | | |
|---|---|---|---|
| 4,112,586 | 9/1978 | Lehtinen | 34/9 |
| 4,461,095 | 7/1984 | Lehtinen | 34/41 |
| 4,506,456 | 3/1985 | Lehtinen | 34/73 |
| 4,506,475 | 3/1985 | Lehtinen | 34/73 |
| 4,622,758 | 10/1986 | Lehtinen | 34/41 |

*Primary Examiner*—Karen M. Hastings
*Attorney, Agent, or Firm*—Ladas & Parry

[57] ABSTRACT

A method for drying a fibre web such as a paper or paper board web, wherein air is first removed from the web and a dryer felt, whereafter they are led together between two parallel metal bands moving at the same speed as the web and the felt. For drying the web, the band on the side of the web is heated by means of a heating device before the band reaches the drying zone and, correspondingly, the band on the side of the dryer felt is cooled before the band reaches the drying zone and comes into contact with the dryer felt. In the method, for adjusting the mechanical Z compression exerted peripendicularly on the surface of the web, the temperature of the cooling band is adjusted so that the difference between the condensation pressure of the steam condensed on the surface of the band on the side of the dryer felt and the pressure acting on the outer surface of the bands is substantially equal to the desired mechanical Z compression. Further, the drying rate of the web is adjusted by adjusting the temperature of the heated band by means of the heating device in such a way that a desired amount of water can be evaporated from the web within the drying zone. Since the pressure loss created by the steam flowing through the dryer felt is substantially insignificant with respect to the condensing pressure of the steam condensing on the surface of the band, and the temperature difference between the heated band and the cooled band affects substantially this pressure loss only, these adjustments do not substantially affect each other and they can be carried out in desired order and adjusted suitably in view of the properties of the web to be dried.

7 Claims, 1 Drawing Sheet

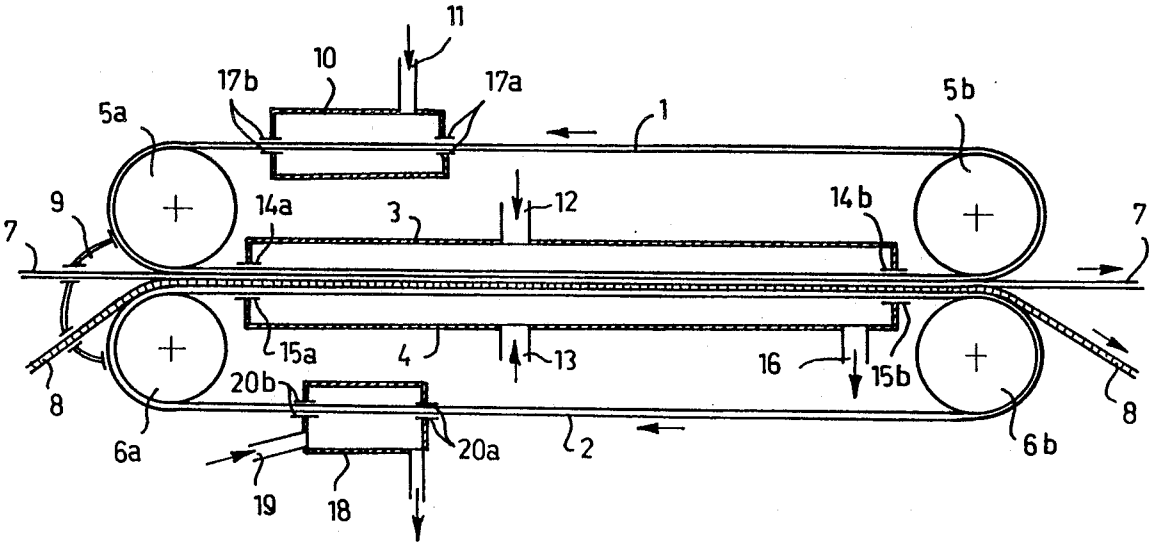
7
8
6b
5b
15b
14b
16
1
2
12
13
17a
20a
11
3
4
10
18
14a
15a
20b
19
17b
5a
6a
9
7
8

METHOD OF DRYING A PAPER BOARD OR PAPER WEB

The invention relates to a method of drying a paper board or paper web by leading the web together with at least one dryer felt between two moving, airtight bands having a good thermal conductivity and being substantially parallel with each other over a distance, the bands enclosing the web therebetween over the entire width thereof, thus forming a drying zone, wherein the web and each dryer felt are exposed to an air removal treatment before being led between the bands, whereby air is removed out of their pores to the greatest possible degree; a substantially equal pressure is arranged to act on the outer surface of each band; the band making contact with the web is exposed to a heat treatment at least prior to the drying zone for evaporating water from the web, and the band making contact with the dryer felt is exposed to a cooling treatment for condensing the water evaporating from the web into the dryer felt; and the dryer felt is separated from the dried web after the bands and the condensed water is removed therefrom.

Finnish Patents 54514, 61537 and 69141, among others, describe the drying of a moving web in a space which is defined between a heated and a cooled surface and which is as free of air as possible.

Finnish Patent No. 54514 (U.S. Pat. No. 4,112,586) discloses a solution in which the surface positioned against the web is heated to about 100° C., and the surface positioned against the dryer felt is cooled to a relatively low temperature typically below 40° C. Finnish Patent No. 61537 (U.S. pat. 4,461,095) in turn, discloses a solution in which the surface positioned against the web is heated to a high temperature typically about 180° C., and the cooling surface is kept at a temperature typically above 100° C., whereby the surfaces have to be pressed against each other with a high pressure typically above 0.3 MPa in order to prevent the boiling of the water contained in the web and in the dryer felt.

The above solutions are intended to be applied in such a way that both the heated and the cooled surface are metal bands moving in the direction of movement of the web at the same speed as the web, whereby a web to be dried and a dryer felt, wire or some other mat permeable to steam are led between the bands in such a way that the web to be dried will be positioned against the heated band and the dryer felt or the like against the cooled band so that the other side of the dryer felt or the like will be positioned against the web to be dried. In the embodiments disclosed, a fixed box containing pressurized saturated steam is positioned outside the heated metal band. The box is open towards the moving metal band in such a way that the steam is in direct contact with the metal band or a condensate forming thereon, the edges of the box being sealed off against the surface of the band. A box similar to that described above is positioned outside the cooled metal band, water being fed into the box approximately at the pressure of the steam contained in the box positioned outside the heated band but at a temperature lower than that of the steam.

In addition to the embodiment described above, Finnish Patent 61537 further discloses an application in which the hot surface consists of the outer surface of an internally heated metal cylinder, and the cooled surface of a metal band extending almost around the cylinder in parallel with the surface thereof, whereby the web and the dryer felt are led between the cylinder and the band moving at an equal rate.

In the above-described applications, heat is transferred to the hot metal surface within the drying zone itself through the band, that is, through the metal layer one surface of which consists of said hot metal surface. Heat is transferred into the metal layer from a source of heat positioned behind the other surface of the metal layer, when saturated steam condenses and delivers its latent heat into the metal band. In the solutions disclosed, no appreciable amounts of heat are transferred into the metal band outside the drying zone when the band moves within the area of the steam box. In practice, the metal band is endless, so that heat is dissipated from the metal band outside the press section into the rolls intended for the rotation of the band and into the ambient air. As the hot surface within the drying zone consists of the outer surface of the metal cylinder, heat is transferred into the metal casing from the source of heat positioned within the cylinder typically over the whole peripheral length of the casing. However, this is disadvantageous in that due to the thickness of the cylinder casing the amount of heat which is transferred from within the casing to the outer surface thereof is considerably smaller than the amount of heat transferred through a thin metal band, wherefore very high temperatures are required in the cylinder in order that the heat flux required for the drying of the web could be transferred to the surface of the cylinder. This, in turn, requires that the steam should be very hot, which is economically disadvantageous. Consequently, the use of a metal band as a hot a surface is economically more advantageous.

Attention has been paid to these matters in the solution disclosed in Finnish Patent No. 69141, (U.S. Pat. No. 4,622,758) where the outer surface of a conventional thick-walled drying cylinder acts as a cooled surface in the drying process while a relatively thin metal band acts as the hot metal surface. For a major part the metal band is heated outside the drying zone formed by the cylinder and the band before the band reaches the drying zone. In this solution, the metal band is not actually heated within the drying zone but the heat required in the metal band for the evaporation of the moisture contained in the web is for a major part derived from the heat energy transferred to the metal band during the preheating step. Thereby the average temperature of the metal band drops within the drying zone in proportion as the drying proceeds and the band moves on within the drying zone together with the web.

In the above patents, it is shown by examples that in practice a preheating rising the temperature of the metal band by a few tens of degrees provides sufficiently energy for the evaporation of a high amount of moisture from the web without having to heat the metal band within the drying zone.

All the above applications have the drawback that during the drying process the drying of the web is dependent on the pressure of the cooling water, the temperature of the cooling water, and the mechanical compression exerted on the web perpendicularly to the surface of the web, i.e., a Z compression, which is due to the following matters.

After having penetrated part of the web and the wire or felt, the steam evaporated from the web is condensed on to the cooled band or on to the condensate formed thereon at a saturation pressure corresponding to the local temperature. The local temperature, in turn, is determined by the temperature of the cooling water. The temperature of the cooling water is affected by the temperature difference caused by the heat transfer from the cooling water to one side of the cooled band and further therefrom to the other side of the cooled band. Further, the pressure of the steam at the wire or felt making contact with the surface of the web is determined by the above-mentioned condensation pressure which is affected, though to a small degree, by the pressure loss occurring when the steam passes from the interspace between the web and the wire to the condensation surface. In accordance with the force balance, the mechanical Z compression to be exerted on the surface of the web is equal to the difference between the pressure exerted on the outside of the hot and the cold band and the pressure of the steam in the interspace between the web and the wire.

In the publications mentioned above, the disadvantageous dependence between the temperature and the drying rate typical of other drying processes has been eliminated by adjusting the temperature of the cooling surface to such a high value that the drying rate is decreased to a desired level. However, there still remains the restrictive factor that the temperature of the heating steam and correspondingly the pressure thereof as well as the temperature of the cooling water and the mechanical Z compression exerted on the web are dependent upon each other. For the adjustability of the drying process, this dependence is very disadvantageous and causes unnecessary expenses and impairs the operational optimization of the drying process in the production of a paper board and paper web.

The object of the invention is to provide a method by means of which the restrictive factors and drawbacks of the drying procedures described above are avoided and by means of which each one of the three important process parameters, i.e., the temperature of the web, the local drying rate, and the mechanical Z compression exerted on the web, can be adjusted to a desired level separately in each drying zone, whereby the length of the drying zones can be varied within limits as wide as possible and the drying process can be optimized in view of both the quality of the web and the production process as a whole. The method according to the invention is characterized in that for adjusting the mechanical compression exerted on the web to a desired value, the pressure acting on the outer surface of the bands and the temperature of the cooling band are adjusted so that the difference between the pressure acting on the outer surface of the bands and the saturation pressure of the steam determined by the temperature of the cooling band is substantially equal to the desired mechanical compression force; and for adjusting the drying rate of the web to a desired value the temperature of the band exposed to the heat treatment and heating the web is adjusted before it reaches the drying zone so that it corresponds to the desired drying rate.

The basic idea of the invention is that the magnitude of the mechanical Z compression to be exerted on the web within the drying zone is determined, and the external pressure acting on the outside of the bands pressing them towards each other and the temperature of the band to be cooled are adjusted in such a way that the pressure difference between the pressure acting on the bands and the pressure of the condensing steam is essentially equal to the desired mechanical Z compression; on the other hand, the temperature of the band to be heated is adjusted to a suitable value on the basis of the desired drying rate. According to the invention, either one of these adjustments can be effected first, because the temperature difference between the bands does not affect the Z compression to any greater degree in view of the pressure adjustment.

BRIEF DESCRIPTION OF THE DRAWINGS

The invention will be described in more detail with reference to the attached FIGURE, which shows an apparatus suitable for realizing one application of the method according to the invention.

The dryer comprises a heated metal band 1 and a cooled metal band 2 which move in parallel with each other through a drying zone. A steam box 3 is provided for the heated metal band and a water box 4 for the cooled metal band. The heated band 1 moves around its turning rolls 5*a* and 5*b* and the cooled band 2 around its turning rolls 6*a* and 6*b*. A web 7 to be dried is passed into the drying zone so as to make contact with the lower surface of the heated metal band 1; in this embodiment, this lower surface acts as the hot surface within the drying zone. A dryer felt 8 permeable to gas and formed by one or more felts and/or wires positioned one upon another is correspondingly passed between the bands 1 and 2 in such a way that one surface of the dryer felt 8 makes contact with the cooled metal band 2 while the other surface thereof makes contact with that surface of the web 7 to be dried which faces away from the heated metal band. Both the web 7 and the dryer felt 8 are passed through an air removal unit 9 before being led between the bands. In the air removal unit, air is removed from the pores of the web 7 and the dryer felt 8 to the greatest possible degree e.g. by applying therethrough saturated steam at a suitable temperature so that the air molecules are pushed out of the pores and replaced with water molecules contained in the steam. For heating the heated band, a heating unit 10 is provided on both sides of the heated band 1 at a point where it moves alone, i.e., between the rolls 5*a* and 5*b* outside the drying zone formed between the rolls 5*a* and 5*b* and 6*a* and 6*b*, respectively. By means of the heating unit the temperature of the band 1 is adjusted to a temperature corresponding to the desired drying rate by applying hot medium 11 through the heating unit 10. The medium may consist of steam, flue gases from fossil fuels or some other gas heated to a suitable temperature. It is obvious that the invention also comprises an application in which the band 1 is heated by some electrical method within some other portion of the band than the drying zone and an application in which heat is transferred to the band from a stationary surface in contact therewith, such as one or both of the turning rolls 5*a* and 5*b*.

In the heating unit 10 the band is heated to a desired temperature, whereby the heated band section moves around the turning roll 5*a* to the entry end of the drying zone and makes contact with the transported web 7. Steam 12 at a suitable temperature and pressure is introduced into the steam box 3 provided for the heated band. Correspondingly, cooling water 13 at a desired temperature and at a pressure substantially equal to the pressure of the steam 12 is introduced into the water box 4. However, the pressure of the cooling water is preferably slightly higher than that of the steam 12 for supporting the bands 1 and 2 as well as the web 7 and the dryer felt 8. Part of the steam 12 may escape past edge seals 14*a* and 14*b* provided between the band 1 and the box 3 and past seals (not shown) provided on the sides of the box 3 so as to be pressed against the band either in the form of steam or condensate. When the rest of the steam is condensed on the upper surface of the band 1, it is gathered and removed from the box 3 by means of suitable devices not shown. From the box 4, part of the water leaks between seals 15*a* and 15*b* and between side seals provided on the water box 4 against the band 2, while the remaining warmed cooling water 16 is removed through one end of the box 4.

In the method, the pressure of the steam 12 and that of the water 13 are adjusted so that a predetermined external pressure acts on the bands, which pressure tends to compress the web 7 perpendicularly to the surface thereof in a direction Z. To achieve the desired mechanical Z compression, the feeding temperature of the cooling water 13 is now adjusted to a value such that the pressure of the steam condensing on the surface of the band 2 on the side of the dryer felt 8 settles on the desired level so that the difference between the external pressure acting on the outside of the bands 1 and 2 and the condensation pressure of the condensing steam is equal to the compression to be exerted on the web 7. In a case taken as an example, the steam contained in the steam box 3 is at a temperature of about 100° C. and at a pressure only slightly above the atmospheric pressure, and the temperature of the water contained in the water box 4 is about 30° C. In this case, the steam evaporated from the web 7 is condensed on the upper surface of the cooled band 2 typically at about 80° C. and the condensing pressure of the steam would be 47.3 kPa. Since the pressure loss from the interspace between the web 7 and the dryer felt 8 to the condensing surface of the band 2 would be about 230 Pa, the steam pressure in the interspace between the dryer felt 8 and web 7 would be about 47.6 kPa and the mechanical Z compression exerted on the web would be about 101.3 kPa−47.6 kPa=53.7 kPa. The pressure value 101.3 kPa is the magnitude of the external pressure exerted on the web. Supposing that the metal band 1 to be heated would reach the drying zone at 150° C. and the web 7 would consist of newsprint with a gram image of 45 g/m$^2$ and a dry matter content of 45%, the drying rate would, however, be typically about 200 kg/(s x m$^2$).

In the case described above, it would be very easy to alter the Z compression exerted on the web without substantially affecting the drying rate. The only alteration required would be to change the temperature of the cooling water. With a cooling water temperature of 40° C., for instance, the situation would be as follows. The temperature of the steam condensing on the band 2 would be about 90° C. and, correspondingly, the condensing pressure of the steam about 70.1 kPa. The pressure loss from the interspace between the web 7 and the dryer felt 8 to the condensing surface of the band 2 would now be about 160 Pa and the pressure of the steam in the interspace between the web 7 and the dryer felt about 70.3 kPa. The Z compression exerted on the web 7 would be 101.3 kPa−70.3 kPa=31.0 kPa. The drying rate, however, would substantially the same as above, that is, at remain about 200 kg/(s x m$^2$).

However, it is obvious that the drying method according to the invention also offers an opportunity to use compressed steam in the steam box 3 while the band 1 is preheated in a preheater 10. According to the invention, it would thereby be possible to adjust the mechanical Z compression exerted on the web 7 to any level within the range from 0 to $p_m$, wherein $p_m$ is slightly lower than the saturation pressure of the steam created at the lowest temperature of the band 1 occurring within the drying zone. According to the invention it is thus possible to separately adjust the Z compression undergone by the web 7 to a desired level while the drying rate can be kept even at a very high value or, if required by the properties of the web, at a very low value. As it is sufficient for the drying process that the band 1 to be heated is heated before it reaches the drying zone, a substance such as steam or gas at a suitable temperature can be introduced into the box 3, whereby the function of the substance is not to heat the band 1 but merely to act as a medium for transmitting pressure to the surface of the band 1. Correspondingly, the cooling of the cooled band 2 can be effected before it reaches the drying zone by means of a separate cooling device 18 into which cooling medium 19 is introduced for cooling the band to a suitable temperature. The cooling device 18 is sealed on the surface of the band 2 by means of seals 20*a* and 20*b* positioned on both sides thereof and correspondingly by side seals (not shown) extending in the direction of movement of the band. When the band 2 is cooled by the cooling device 18, water at a suitable pressure and temperature can be introduced into the water box 4, the function of the water being mainly to transmit pressure to the outer surface of the band 2.

Only one embodiment of the method according to the invention and one way of applying it have been described above. However, the invention is by no means restricted to the embodiment disclosed, but it can be varied freely within the scope of the claims. If both the heated and the cooled surface are heated and cooled, respectively, before they reach the drying zone, it is possible to apply atmospheric pressure, for instance, within the drying zone, whereby in certain cases the steam box 3 can be omitted, and air or some other gas can be introduced in place of water into the box 4 merely for supporting the bands and the web and dryer felt positioned therebetween, provided that the apparatus is horizontally positioned. When the atmospheric pressure acts on the bands 1 and 2, the magnitude of the mechanical Z compression acting on the web 7 can be adjusted simply by varying the temperature of the band 2 by means of the cooling device 18. Correspondingly, the drying rate can be simply adjusted by means of the heating device 10 of the band 1, and the whole process can be controlled easily and simply.

I claim:

1. A method of drying a paper board or paper web by leading the web together with at least one dryer felt between two moving, air-tight bands having a good thermal conductivity and being substantially parallel with each other over a distance, the bands enclosing the web therebetween over the entire width thereof to form a drying zone having a drying rate, the method comprising the steps of:

exposing a web and a dryer felt to an air removal treatment whereby air is removed out of pores to the greatest possible degree;

passing said web and dryer felt between two moving, air-tight bands which are substantially parallel to each other;

subjecting an outer surface of each of said bands to substantially equal pressure;

heating the one of said bands which makes contact with said web prior to entry into said drying zone to a temperature for evaporating water from said web;

cooling the other of said bands which makes contact with said dryer felt to a predetermined temperature before it reaches said drying zone for condensing said water evaporated from said web into said dryer felt;

separating said dryer felt from said web after passing through said bands and removing condensed water therefrom;

adjusting the mechanical compression exerted on the web to a predetermined value by adjusting the pressure acting on the outer surface of the bands and the temperature of the cooling band to produce a difference between the pressure acting on the outer surface of the bands and the saturation pressure of steam condensed in drying said web determined by the temperature of the cooling band which is substantially equal to the desired mechanical compression force; and adjusting the drying rate of the web to a desired value by adjusting the temperature of the band exposed to said heating which heats said web before it reaches said drying zone so that it corresponds to the desired drying rate.

2. A method according to claim 1 wherein said subjecting step applies atmospheric pressure on the outer surface of said bands.

3. A method according to claim 2 wherein said pressure is transmitted to said outer surface of said band heating said web by means of a gas or a gas mixture.

4. A method according to claim 2 wherein said pressure is transmitted to said outer surface of said band heating said web by means of steam.

5. A method according to claim 2 wherein said pressure is transmitted to said surface of said band cooling said dryer felt by means of a gas or a gas mixture.

6. A method according to claim 2 wherein said pressure is transmitted to said outer surface of said band cooling said dryer felt by means of a liquid.

7. A method according to claim 6 wherein said liquid is water.

* * * * *